United States Patent [19]

Oka et al.

[11] 4,180,417

[45] * Dec. 25, 1979

[54] PHOSPHATING OF METALLIC SUBSTRATE

[75] Inventors: Shoji Oka, Ando; Ryoichi Murakami, Osaka; Akiko Sueyoshi, Onodai, all of Japan

[73] Assignee: Nippon Paint Co., Ltd., Japan

[ * ] Notice: The portion of the term of this patent subsequent to Sep. 12, 1995, has been disclaimed.

[21] Appl. No.: 950,620

[22] Filed: Oct. 12, 1978

[30] Foreign Application Priority Data

Oct. 12, 1977 [JP] Japan ..... 52-122856

[51] Int. Cl.[2] ..... C23F 7/10

[52] U.S. Cl. ..... 148/6.15 Z; 148/6.15 R; 204/181 R; 204/DIG. 13

[58] Field of Search ..... 148/6.15 R, 6.15 Z; 427/345; 204/DIG. 13

[56] References Cited

U.S. PATENT DOCUMENTS

| | | | |
|---|---|---|---|
| 3,401,065 | 9/1968 | Steinbrecher et al. | 148/6.15 Z |
| 4,113,519 | 9/1978 | Oka et al. | 148/6.15 R |

*Primary Examiner*—Ralph S. Kendall

*Attorney, Agent, or Firm*—Wenderoth, Lind & Ponack

[57] ABSTRACT

In a method for phosphating the surface of a metallic substrate by treatment with a phosphating solution containing nitrite ions as the accelerator, an improvement wherein the supply of the nitrite ions to the phosphating solution is carried out by electrolytic reduction of nitrate ions present in the phosphating solution while changing the direction of the current flow at a fixed interval of time, whereby a desired concentration of nitrite ions in the phosphating solution is maintained without accumulation of alkali metal and/or ammonium ions unavailable for the phosphating and also without accumulation of precipitates on the electrode, and a uniform phosphate coating film having satisfactorily good coating properties is formed on said surface.

13 Claims, 2 Drawing Figures

PHOSPHATING OF METALLIC SUBSTRATE

Figure 1:
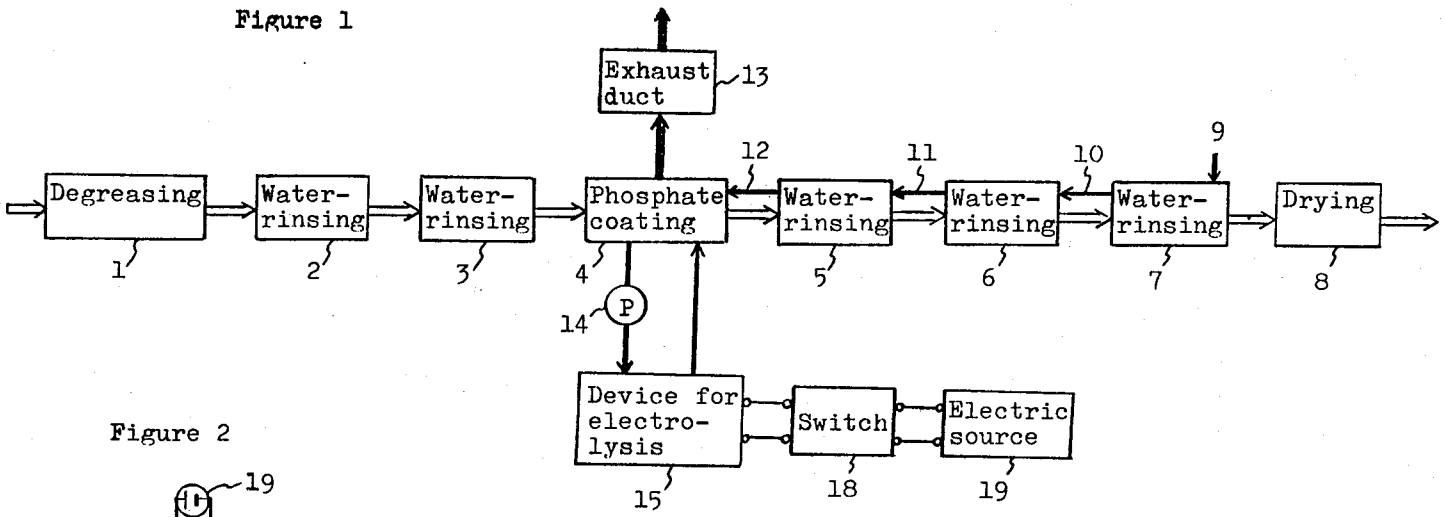

The present invention relates to an improvement in phosphating of a metallic substrate. More particularly, it relates to an improved method for formation of a phosphate coating film having good coating properties on the surface of a metallic substrate by treatment with a phosphating solution while maintaining appropriate concentrations of useful nitrite ions in the phosphating solution without accumulation of unfavorable ions.

The drawing discloses an embodyment of the invention.

In a phosphating process, metallic ions available for formation of a phosphate coating film and other ionic components in the phosphating solution are consumed with the progress of phosphating. Further, the loss of the ionic components in considerable amounts occurs since those are taken out as the "dragout" with the metallic substrate to be phosphated from the phosphating solution. Therefore, replenishment of the ionic components to the phosphating solution becomes necessary in the course of phosphating. Such replenishment is also needed for concurrently maintaining the acid ratio and total acidity of the phosphating solution and the concentrations of the ionic components at appropriate levels.

Among various ionic components, nitrite ions available as an accelerator are usually replenished by adding alkali metal and/or ammonium nitrites to the phosphating solution. Such replenishment, however, permits the accumulation of alkali metal and/or ammonium ions unavailable for formation of a phosphate coating film and concurrently raises a pH value of the phosphating solution, thereby causing the precipitation of zinc phosphate according to the following reaction formula:

$$3Zn(H_2PO_4)_2 \rightleftharpoons 4H_3PO_4 + Zn_3(PO_4)_2 \downarrow$$

Thus, the precipitation of zinc phosphate gives rise to a decrease in the concentration of zinc ions in the phosphating solution. Further, the nitrite ions in the phosphating solution are partly converted into nitrate ions by oxidation, thereby resulting in a high concentration of nitrate ions, which imparts the phosphating. As a consequence, an insufficient phosphate coating film is formed on the surface of the metallic substrate, and poor coating or rusting results.

On the other hand, the phosphating solution which is carried away as the "dragout" by adhering to the metallic substrate is drained together with a large amount of water. This drain, however, is a cause of contamination or pollution if it is directly discharged without any waste disposal treatment to remove the heavy metal ions present therein. The said drain should accordingly be treated prior to discharge, and such a waste disposal treatment raises the cost of the phosphating. The use of a large amount of water may also present a problem from an environmental point of view. In order to obviate these disadvantages, the employment of an apparatus as described and claimed in U.S. Pat. No. 3,906,895, in which little or no phosphating solution is drained off from the phosphating system is particularly preferred. The problem here, however, is that, since the apparatus is of the type designed to drain off little or no phosphating solution out of the phosphating system, accumulation of the undesired ions may take place faster than when an apparatus of the conventional type, i.e. one designed to drain off a considerable amount of waste is employed. In addition, the more occasional renewal of the phosphating solution is required insofar as a conventional phosphating solution is employed.

When a phosphating solution which contains a nitrite such as alkali metal nitrite or ammonium nitrite as the accelerator is used, the following two points should be mainly considered to solve the problems as described hereinabove and to provide a satisfactory phosphate coating film on a metallic substrate. First, the phosphating process should be carried out in which the accumulation of alkali metal and/or ammonium ions can be prevented or removal thereof made with ease. If the use of nitrous acid is possible, the problem with the accumulation of those unfavorable ions may be avoidable. However, nitrous acid cannot be used effectively under conventional conditions because of its instability in chemical properties and difficultly in handling. Secondly, the accumulation of nitrate ions in a phosphating solution to an undesirably high concentration should be prevented or the accumulated nitrate ions should be removed with ease.

In order to avoid the disadvantages involved in conventional phosphating processes, some attempts have been made; for example, U.S. Pat. No. 3,015,594 discloses the use of highly acidic cation-exchange resins substantially saturated and loaded with the coating metal ions. Since these cation-exchange resins possess a negatively charged matrix and exchangeable positive ions (cation) as is well known to the art, they cannot function as an exchange for anions. Thus the sole employment of cation-exchange resins cannot decrease the nitrate ions accumulated in the phosphating solution to high concentration. U.S. Pat. No. 3,996,072 proposes the use of anion-exchange resin for treatment of the phosphating solution for obviating the disadvantages present in the use of cation-exchange resins. While this method is quite successful, it still has drawbacks such as requiring treatment of anion-exchange resins for regeneration, which makes the operation complicated. Further, a troublesome problem of disposal of waste materials (e.g. sodium nitrate) arises from such regeneration treatment.

The present invention have already found that the application of a direct current to electrodes available as the cathode and the anode and dipped in a phosphating solution containing nitrate ions reduces electrolytically the nitrate ions to nitrite ions as shown in the following formula.

$$NO_3^- + 3H^+ + 2e \rightarrow HNO_2 + H_2O$$

and that the appropriate control of the conditions in the electrolytic reduction makes it possible to maintain a constant concentration of nitrite ions in the phosphating solution (cf. U.S. Ser. No. 791,470, U.S. Pat. No. 4,113,519).

However, when the electrolytic reduction is continued for a long period of time, precipitates adhere onto the electrode as the cathode and thereby the conversion efficiency of from nitrate ions to nitrite ions is gradually decreased. Moreover, with increase of the precipitates accmulated on the electrode, the ratio of the useful components in the solution, for instance, zinc ions in a phosphating solution containing zinc phosphate are decreased.

As a result of further intensive study by the present inventors, it has now been found that when the direction of the current flow is alternately changed at a fixed interval of time and the electrode is switched over from plus to minus or from minus to plus, the precipitates accumulated on the electrode are re-dissolved to recover normal surface of electrode, and thereby, the nitrite ions are constantly produced and also other useful components such as zinc ions can be kept in a constant concentration.

An object of the present invention is to provide an improved method for controlling a phosphating solution, particularly the ionic concentrations in such a solution. Another object of the invention is to provide a method for phosphating the surface of a metallic substrate with a phosphating solution, in which the nitrite ions are maintained at a desired level without accumulation of unfavorable ions and also without accumulation of unfavorable precipitates on the electrode as the cathode. A further object of the invention is to provide a method for formation of a phosphate coating film having good coating properties on the surface of a metallic substrate continuously with a phosphating solution, in which the concentration of nitrite ions is appropriately controlled without accmulation of unfavorable ions and also without accumulation of precipitates on the electrode as the cathode. These and other objects of the present invention will be apparent from the following description.

According to the present invention, a phosphating solution containing nitrate ions is subjected to electrolytic reduction for conversion of the nitrate ions into nitrite ions so as to attain a desired level of nitrite ions in the phosphating solution while changing the direction of the current flow at a fixed interval of time.

Phosphating solutions as conventionally used for a phosphating process may be employed for the present invention. Such solutions can generally contain a variety of ions such as chloride, fluoride, borohydrofluoride, silicohydrofluoride, titanium hydrofluoride, tartrate, citrate, lactate, glycerophosphate, acid pyrophosphate, acid orthophosphate and nitrite ions, and metal ions such as zinc, manganese, iron and calcium ions. Although these conventional solutions are applicable to the present invention, preferable phosphating solutions to be used possess a pH value of from about 1.0 to 4.0. The acidic phosphate coating solution which are applicable to the process of the present invention may include an acidic zinc phosphate coating solution, acidic zinc calcium phosphate coating solution and acidic zinc manganese phosphate coating solution. The acidic zinc phosphate coating solution may contain, as the essential ionic components, zinc ions, phosphate ions, nitrate ions and nitrite ions, respectively, in concentrations of from about 0.03 to 1% by weight, from about 0.2 to 10% by weight, from about 0.2 to 5% by weight and from about 0.002 to 0.1% by weight. Practically, it has the following composition: zinc ions, from about 0.05 to 0.5% by weight; sodium ions, from 0 to about 0.5% by weight; phosphate ions, from about 0.2 to 2.0% by weight; nitrate ions, from about 0.2 to 2.0% by weight; and nitrite ions, from about 0.005 to 0.5% by weight. The acidic zinc calcium phosphate coating solution may contain calcium ions in an amount of from about 0.01 to 2.0% by weight in addition to the said composition of the acidic zinc phosphate coating solution. The acidic zinc manganese phosphate coating solution may contain manganese ions in an amount of from about 0.01 to 0.5% by weight in addition to the said composition of acidic zinc phosphate coating solution.

The phosphating solution may also contain other conventional additives and accelerators, but when the phosphating solution contains nickel ions as a metal ion accelerator in an amount of more than 100 ppm, the production efficiency of nitrite ions is significantly decreased and hence nitrite ions are almost not supplied.

Since nitrite ions can be produced from nitrate ions as the result of the electrolytic reduction, the initial composition of the phosphating solution is not necessarily required to include nitrite ions. Usually, however, the phosphating solution is favored to include nitrite ions from the beginning, because it takes a relatively long time to obtain the desired level of nitrite ions by the electrolytic reduction, particularly when the apparatus and conditions for electrolysis are suitable for compensation of the consumed and/or lost amount of nitrite ions in the phosphating process so as to maintain a constant level of nitrite ions. Such initial concentration of nitrite ions may be made by any conventional procedure, for instance, by adding alkali metal nitrite (e.g. sodium nitrite) or ammonium nitrite to the phosphating solution. The amount of the nitrite for making the initial concentration of nitrite ions is so small that any unfavorable influence is not materially caused by alkali metal or ammonium ions, which are necessarily incorporated into the phosphating solution through the said addition. A favorable initial concentration of nitrite ions is within a range of 0.002 to 0.1% by weight, and this level may be preferably maintained during the phosphating. The initial concentration of nitrate ions in the phosphating solution is usually 0.2% by weight or higher, and the concentration of nitrate ions during the phosphating is preferred to be kept within a range of 0.2 to 5% by weight. When the concentration of nitrate ions is less than 0.2% by weight, the production efficiency of the nitrite is considerably decreased, and a large scale apparatus for electrolysis becomes necessary. In addition, the maintenance of the nitrite ions at a favorable level will become difficult. Besides, the concentration of heavy metal ions in the phosphating solution should preferably be less than 0.5% by weight. When the concentration of heavy metal ions is over 0.5% by weight, a larger amount of precipitates are adhered and accumulated onto the electrode, and hence, even if the direction of the current flow is changed, there can hardly be prevented undesirable decrease of heavy metal ions (e.g. zinc ions) in the solution.

The electrolytic reduction may be carried out by passing a direct current between at least one electrode as the cathode and at least one electrode as the anode, which are dipped in the phosphating solution, whereby the conversion of nitrate ions into nitrite ions takes place at the cathode. The electric current density at the cathode is usually from 0.01 to 15 A/dm$^2$, preferably from 0.1 to 8 A/dm$^2$, particularly from 0.5 to 3 A/dm$^2$. When the electric current density is more than 15 A/dm$^2$, the efficiency in the conversion of nitrate ions into nitrite ions is lowered. When less than 0.01 A/dm$^2$, a larger area of electrode is required, and a device of a larger scale becomes necessary. The electric current density at the anode may vary within a wide range and is usually not more than 30 A/dm$^2$. When the electric current density is over 30 A/dm$^2$, the efficiency in the conversion of nitrate ions into nitrite ions becomes inferior. In case of the electric current density being too small, a great area of electrode becomes necessary, and therefore it may be usually not less than 0.01 A/dm$^2$.

As mentioned hereinbefore, however, when the electrolytic reduction is continued for a long period of time without changing the direction of the current flow, a large amount of precipitates are adhered and accumulated onto the electrode as the cathode which results in remarkable decrease of production efficiency of the nitrite ions and further difficulty of re-dissolution of the precipitates. Accordingly, the direction of the current flow should be changed at a fixed interval of time, usually at an interval of 30 minutes or shorter. On the other hand, when the direction of the current flow is changed within a very short period of time, the produced nitrite ions tend to be easily oxidized to re-form nitrate ions. Thus, preferred interval of time for changing the current direction may be in the range of from 10 seconds to 30 minutes, more preferably from 15 seconds to 7 minutes.

As the electrode, there is advantageously employed an electrode having an excellent efficiency for conversion of nitrate ions into nitrite ions which generates in the electrolysis little or substantially no hydrogen gas when used as the cathode, and further is insoluble or hardly soluble in the phosphating solution when used as the anode. Suitable examples of the electrode are those made of stainless steel, or carbon. Thus, in one embodiment, both electrodes are made of stainless steel or carbon, which are alternately used as the cathode and as the anode. In another embodiment, an electrode made of stainless steel oo carbon may be used as one electrode (i.e. the cathode or anode) and another electrode made of platinum, platinum-plated titanium, oxidized noble metal such as oxides of noble metals (e.g. ruthenium, or iridium) coated on titanium or tantalum, magnetite (triiron tetroxide) or lead dioxide may be used as another electrode (i.e. the anode or cathode). The electrode made of the latter listed materials has an inferior efficiency of conversion of from nitrate ions into nitrite ions when used as the cathode, but it is preferable because it is insoluble or hardly soluble in the phosphating solution when it is changed to and used as the anode. Thus, when one electrode is made of stainless steel or carbon and another electrode is made of other materials as mentioned above, the production efficiency of nitrite ions in the system may be lower than the case of using both electrodes made of stainless steel or carbon, but these electrodes are alternated at a fixed interval of time, and hence, a certain conversion efficiency of from nitrate ions into nitrite ions can be obtained. Moreover, if the electrode made of stainless steel or carbon is used as the cathode for a longer period of time, the production efficiency of nitrite ions can be increased.

The method of the present invention can control the phosphating solution by replenishing nitrite ions themselves without replenishing a nitrite as the accelerating material, thereby not allowing the alkali metal and/or ammonium ions to accumulate in the phosphating solution and concurrently decreasing the amounts of salts of phosphate and the ions unavailable for formation of a phosphate coating film. Furthermore, the present invention can avoid a decrease in zinc ions due to the accumulation of alkali metal and/or ammonium ions in the phosphating solution. The present invention can also decrease any excessive amount of phosphate ions which are consumed for the neutralization of alkali metal and/or ammonium ions so that the phosphating also becomes feasible in the total acid pointage of the solution ranging from about 2.5 to 7 points (as determined by the number of millimeters of 0.1 N sodium hydroxide solution required to neutralize 10 milliliters of the coating solution to a phenolphthalein end point); the phosphating according to the present invention can be effected far below the range, e.g. from 8 to 50 points, in which conventional methods are possible. The method of the present invention can also be carried out in a lower temperature and/or for a shorter period of time than conventional methods can.

In practice, the method of the present invention may be introduced into a phosphating process which comprises a series of steps. Thus, a conventional process for phosphating usually comprises the steps of cleaning or degreasing, water-rinsing, phosphate coating, water-rinsing and drying. The film formation step is the application of a phosphating solution to the surface of a metallic substrate to be phosphated by an appropriate operation (e.g. dipping, spraying). When the application is carried out by dipping, the surface is dipped in a tank having the phosphating solution therein. When the application is effected by spraying, the phosphating solution is sprayed onto the surface and collected in a tank placed beneath the same. The electrolysis according to this invention may be applied directly to the phosphating solution in such tank. Alternatively, the phosphating solution in the said tank may be circulated through a separate tank wherein the electrolysis according to this invention is carried out. Further, the electrolysis of this invention may be effected intermittently or continuously. In general, the continuous electrolysis so as to maintain a constant concentration of nitrite ions in the phosphating solution is preferred from the industrial viewpoint, while the direction of the current flow is changed at a fixed interval of time. The constant concentration of nitrite ions can be readily maintained by sending a direct current of appropriate and constant electric current density to the phosphating solution.

Explaining the application of the method of this invention to a multiple station system more in details, the preferable installation in such system may comprise six or seven stations. For example, a six-station installation is arranged in which the first station is a cleaning or degreasing station; the second is a first water-rinsing station; the third is a second water-rinsing station; the fourth station corresponds to phosphate coating; the fifth is third water-rinsing station; and the sixth station corresponds to a fourth water-rinsing station; said phosphate coating station being provided with a device for electrolysis by which the phosphating solution is subjected to electrolysis so as to control the nitrite ion concentration at an appropriate level. In the seven-station installation, an acidulating station or another water-rinsing station may be disposed adjacent the last water-rinsing station which is provided for the six-station installation. The metallic substrate, as phosphated passing from the last water-rinsing station, may then be dried conventionally so as to remove the residual liquid from the coated metal surfaces for further processing such as painting. Variations in the number of stations employed for effecting the phosphating can be made, for example, by the omission of one of the rinse stations or the addition thereto of another rinse station.

An apparatus which is described in U.S. Pat. No. 3,906,895 may be applicable preferably to the method of the present invention. The apparatus described in this patent is a spray type apparatus having a spray chamber for treatment of the surface of a metallic substrate with a phosphating solution, followed by rinsing the surface with water, in which little or no phosphating solution is discharged out of the system. In the application of this apparatus to the method of the present invention, a device for electrolysis of the phosphating solution is connected to the phosphating station.

Figure 2:
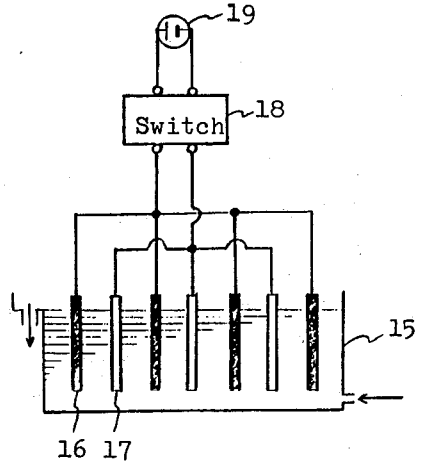

Practical and presently preferred embodiments of the invention will be hereinafter illustrated by way of Examples with reference to the accompanying drawings wherein FIG. 1 shows a flow sheet of an example (the device for electrolysis being used in connection with the tank in the phosphate coating step of the phosphating process) of the invention and FIG. 2 shows a schematic view of a device for electrolysis to be used in connection with a tank in the phosphate coating step of the phosphating process. In the Examples, % is by weight unless specified otherwise.

EXAMPLE 1

A phosphating solution comprising the following ion components (pH, 3.0) is employed:

| Ion | Concentration (%) |
|---|---|
| $Zn^{2+}$ | 0.10 |
| $Na^{+}$ | 0.44 |
| $PO_4^{3-}$ | 1.20 |
| $NO_3^{-}$ | 0.60 |
| $NO_2^{-}$ | 0.0 |

The phosphating process is carried out by using a spray type installation as usually used in zinc phosphate coating (the device for electrolysis being used in connection with the tank in the phosphate coating step of the phosphating process). The phosphating process using such a spray type installation comprises degreasing step (1), two water-rinsing step (2) and (3), phosphate coating step (4), three water-rinsing steps (5), (6) and (7), and drying step (8), as is shown in FIG. 1 of the accompanying drawings. That is, after degreasings, water-rinsing, an iron plate to be treated is subjected to the phosphating coating and thereafter washed with water and dried to give the desired plate having an excellent phosphate film coating.

The tank in the phosphate coating step (4) has a volume of 300 liters. The phosphating solution is circulated into the device for electrolysis (15) by a pump (14). As is shown in FIG. 2 of the accompanying drawings, in the device for electrolysis (15), electrodes (16) and (17) are mutually arranged in parallel with each other, both being made of stainless steel [SUS 24 (18-Cr stainless steel)], and these electrodes (16) and (17) are connected to an electric source of direct current (19) via switch (18). The total effective area of these electrodes is 0.4 $m^2$ and the distance between the electrodes is 2 cm. The phosphating solution (300 liters) is charged into a tank for phosphating coating and is circulated into the device for electrolysis via pump, wherein the temperature in the tank for phosphating coating is kept at 50–55° C. Then, electrolysis is effected under the conditions: electric current density, 1.5 $A/dm^2$; value of total electric current, 30 A; voltage, 5 V; interval of changing of the direction of the current flow, 5 minutes; and total period of time of hydrolysis, 95 minutes. As a result, nitrite ions are produced in the phosphating solution to make a concentration of 0.008%. It is thus confirmed that nitrate ions are reduced into nitrite ions with an electric current efficiency of 60%.

Using the nitrate and nitrite ions-containing phosphating solution thus obtained, phosphating of an iron plate is carried out for 2 minutes. The iron plate thus phosphated is then washed with water three times and dried as shown in FIG. 1. For the water-rinsing, fresh water (9) is supplied to the water-rinsing step (7), the overflow (10) from this step is supplied to the water-rinsing step (6), the overflow (11) from this step is supplied to the water-rinsing step (5), and the overflow (12) from this step is supplied to the phosphate coating step (4), respectively. By the exhaust duct (13), evaporation of water in an amount corresponding to the overflow supplied to the phosphate coating step (4) is effected.

According to the above installation, the dragout from the phosphate coating step (4) can be recovered and returned to the tank in the phosphate coating step (4) without exhaustion of the ions in the phosphating solution to the outside of the system. Further, the amount of fresh water (9) to be used at the water-rinsing step (7) can be reduced.

The zinc phosphate film formed on the article by this Example is uniform and fine and has good properties.

EXAMPLE 2

A phosphating solution comprising the following ion components (pH, 3.0) is employed:

| Ion | Concentration (%) |
|---|---|
| $Zn^{2+}$ | 0.30 |
| $Ca^{2+}$ | 0.54 |
| $Na^{+}$ | 0.64 |
| $PO_4^{3-}$ | 0.60 |
| $NO_3^{-}$ | 3.60 |
| $NO_2^{-}$ | 0.0 |

In the same manner as described in Example 1 except that the electric current sending time is 55 minutes, the above phosphating solution (300 liters) is subjected to electrolysis. As a result, nitrite ions are produced in the phosphating solution to make a concentration of 0.005%. It is thus confirmed that nitrate ions are reduced into nitrite ions with an electric current efficiency of 65%.

Using the nitrate and nitrite ions-containing phosphating solution thus obtained, phosphating of an iron plate is carried out as in Example 1 to form a uniform and fine calcium zinc phosphate film having excellent properties thereon.

EXAMPLE 3

A phosphating solution comprising the following ion components (pH, 3.0) is employed:

| Ion | Concentration (%) |
|---|---|
| $Zn^{2+}$ | 0.28 |
| $Mn^{2+}$ | 0.07 |
| $Na^{+}$ | 0.11 |
| $PO_4^{3-}$ | 1.05 |
| $NO_3^{-}$ | 0.30 |
| $NO_2^{-}$ | 0.0 |

In the same manner as described in Example 1 except that the electric current sending time is 104 minutes, the above phosphating solution (300 liters) is subjected to electrolysis, whereby nitrite ions are produced in the phosphating solution to make a concentration of 0.008%. It is thus confirmed that nitrate ions are reduced into nitrite ions with an electric current efficiency of 55%.

Using the nitrate and nitrite ions-containing phosphating solution thus obtained, phosphating of an iron plate is carried out as in Example 1 to form a uniform and fine manganese zinc phosphate film having excellent properties thereon.

EXAMPLE 4

Using a phosphating solution comprising the ion components as shown in Table 1 (pH, 3.0; degree of free acid, 1.0; total acidity, 15.0; acid ratio, 15), phosphating of an iron plate is carried out continuously in the installation as in Example 1 (treated area, 30 $m^2$/hr; temperature of phosphating solution, 50 to 55° C.). For supply of consumed nitrite ions (consumed amount per treated area of 30 $m^2$/hr, 0.33 mol/hr), addition of an aqueous solution of sodium nitrite (i.e. conventional method) or electrolysis under the same conditions as in Example 1 (i.e. the present invention) is effected. The ion composition of the phosphating solution after 100 and 300 hours from the beginning of the phosphating and the observation results of the phosphate coating film at these times are shown in Table 1.

In case of adopting the conventional method for supply of nitrite ions, a 20% aqueous solution of sodium nitrite is added to the phosphating solution depending on the consumption of nitrite ions to keep a nitrite ion concentration of 0.008%. In the method of the present invention, on the other hand, nitrate ions are reduced into nitrite ions under the same electrolytic conditions as in Example 1 to keep a nitrite ion concentration of 0.008%. For consumed components other than nitrite ions, an aqueous solution mainly containing 2.4 mol/liter of zinc ions and 5.3 mol/liter of phosphate ions is employed in the conventional method, or an aqueous solution mainly containing 2.4 mol/liter of zinc ions, 5.3 mol/liter of phosphate ions and 0.76 mol/liter of nitrate ions is employed in the method of the present invention. The speed of supply is 0.188 liter/hr in both cases.

Table 1

| | Ion concentration of phosphating solution (%) | | | | |
|---|---|---|---|---|---|
| | Initial | Conventional method | | The present invention | |
| | concentration | After 100 hrs | After 300 hrs | After 100 hrs | After 300 hrs |
| $Zn^{2+}$ | 0.10 | 0.056 | 0.023 | 0.09 | 0.10 |
| $Na^{+}$ | 0.44 | 0.60 | 0.86 | 0.45 | 0.44 |
| $PO_4^{3-}$ | 1.20 | 1.20 | 1.18 | 1.20 | 1.20 |
| $NO_3^{-}$ | 0.60 | 0.93 | 1.59 | 0.61 | 0.60 |
| $NO_2^{-}$ | 0.008 | 0.008 | 0.008 | 0.008 | 0.008 |
| Appearance of phosphate coating film | Uniform, fine, excellent | Coarse coating, not uniform, poor | Yellow rust, coarse coating, not uniform, poor | Uniform, fine, excellent | Uniform, fine, excellent |

It is apparent from Table 1 that, by the control according to the conventional method, nitrate ions and sodium ions are accumulated in high concentrations in the phosphating solution, and the concentration of zinc ions is decreased to cause disadvantages in the phosphate coating. According to the method of the present invention, neither the accumulation of nitrate ions and sodium ions nor the decrease of the zinc ion concentration is seen even after 300 hours, and the phosphate coating can be attained satisfactorily.

In the same manner as described above except that the electrolysis is carried out without changing the direction of the current flow, the phosphate coating is continuously effected (the supplement of the consumed components other than nitrite ions is done in the same as above in the present invention). As a result, the concentration of nitrite ions is kept at 0.008% at the initial stage of the treatment, but is gradually decreased with lapse of time and reaches to 0.004% after 30 hours. Besides, the concentration of zinc ions is also decreased to 0.07% at this time.

Thus, when the phosphate coating is carried out without changing the direction of the current flow, the production efficiency of nitrite ions is gradually decreased and the concentration of nitrite ions cannot be maintained at the desired level and further the concentration of zinc ions is also decreased owing to deposition thereof onto the electrode. On the other hand, according to the present invention wherein the electrolysis is carried out by changing the direction of the current flow at a fixed interval of time, as is clear from the results shown in Table 1, the concentration of nitrite ions can be maintained at the desired level even after 100 and 300 hours and the concentration of zinc ions is also maintained without decrease.

In case of applying the method of the present invention to the operation steps of a continuous phosphate coating treatment, a relatively long period of time (95 minutes in case of Example 1 ) is required for elevating the concentration of nitrite ions to the desired level, unless nitrite ions are present in the phosphating solution at the beginning. Therefore, an appropriate amount of sodium nitrite may be added prior to the continuous phosphate coating treatment as seen in this Example. The presence of sodium ions caused thereby does not afford any significant unfavorable influence.

What is claimed is:

1. In a method for phosphating the surface of a metallic substrate by treatment with a phosphating solution comprising nitrite ions and nitrate ions in an aqueous acidic medium, the improvement wherein the supply of the nitrite ions to the phosphating solution is carried out by electrolytic reduction of the nitrate ions therein by passing a direct current between an electrode as the cathode and an electrode as the anode dipped in the phosphating solution while changing the direction of the current flow at an interval of from 10 seconds to 30 minutes.

2. The improvement according to claim 1, wherein both electrodes are made of stainless steel or carbon.

3. The improvement according to claim 1, wherein one of the electrode is made of stainless steel or carbon and another electrode is made of platinum, platinum-plated titanium, oxidized nobel metal, lead dioxide, or triiron tetroxide.

4. The improvement according to claim 1, wherein the direct current has an electric current density of 0.01 to 15 A/$dm^2$.

5. A method for formation of a phosphate coating film on the surface of a metallic substrate which comprises treating said surface with a phosphating solution comprising zinc ions, phosphate ions, nitrate ions, and nitrite ions in an aqueous medium, all or at least a part of the nitrite ions being produced by electrolytic reduction of the nitrate ions in the phosphating solution so that the nitrite ion concentration in solution is replenished in an amount sufficient to produce a satisfactory phosphate coating film; said electrolytic reduction being carried out by passing a direct current between an electrode as the cathode and an electrode as the anode dipped in the phosphating solution while changing the direction of the current flow at an interval of from 10 seconds to 30 minutes.

6. The method according to claim 5, wherein the phosphating solution comprises zinc ions, phosphate ions, nitrate ions and nitrite ions in concentrations of 0.03 to 1% by weight, 0.2 to 10% by weight, 0.2 to 5% by weight and 0.002 to 0.1% by weight, respectively.

7. The method according to claim 6, wherein the phosphating solution has a pH of 1 to 4.

8. The method according to claim 5, wherein both electrodes are made of stainless steel or carbon.

9. The method according to claim 5, wherein one of the electrode is made of stainless steel or carbon and another electrode is made of platinum, platinum-plated titanium, oxidized noble metal, lead dioxide, or triiron tetroxide.

10. The method according to claim 5, wherein the direct current has an electric current density of 0.01 to 15 $A/dm^2$.

11. The method according to claim 5, wherein the treatment is effected by spraying the phosphating solution onto the surface.

12. The method according to claim 5, wherein the surface is degreased and rinsed with water before the treatment.

13. The method according to claim 5, wherein the surface is rinsed with water after the treatment.

* * * * *